US011136945B2

(12) United States Patent
Kaczmar et al.

(10) Patent No.: US 11,136,945 B2
(45) Date of Patent: Oct. 5, 2021

(54) CYLINDER HEAD WITH INTEGRATED EXHAUST MANIFOLD AND DEDICATED EXHAUST GAS RECIRCULATION PORT

(71) Applicant: GM Global Technology Operations LLC, Detroit, MI (US)

(72) Inventors: Michael Kaczmar, Farmington Hills, MI (US); Kenneth M. Eastman, Troy, MI (US); Jason Melecosky, Oxford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 38 days.

(21) Appl. No.: 16/444,391

(22) Filed: Jun. 18, 2019

(65) Prior Publication Data

US 2020/0400107 A1 Dec. 24, 2020

(51) Int. Cl.

| | |
|---|---|
| ***F02M 25/06*** | (2016.01) |
| ***F02M 26/16*** | (2016.01) |
| ***F02M 26/70*** | (2016.01) |
| ***F02F 1/24*** | (2006.01) |
| ***F01N 13/10*** | (2010.01) |

(52) U.S. Cl.

CPC ..... *F02M 26/16* (2016.02); *F01N 13/105* (2013.01); *F02F 1/243* (2013.01); *F02M 26/70* (2016.02)

(58) Field of Classification Search

CPC ..... F02M 26/16; F02M 26/41; F02M 26/43; F02M 26/70; F02F 1/243; F01N 13/105

USPC ..... 60/278

See application file for complete search history.

(56) References Cited

U.S. PATENT DOCUMENTS

| | | | | |
|---|---|---|---|---|
| 3,367,311 | A * | 2/1968 | Tenney | F02B 27/06 123/65 E |
| 3,992,879 | A * | 11/1976 | Miyamori | F01N 3/2053 60/288 |
| 4,020,809 | A * | 5/1977 | Kern | F02D 9/04 123/568.24 |
| 4,711,088 | A * | 12/1987 | Berchem | F01N 3/046 60/321 |
| 5,220,890 | A * | 6/1993 | Koriyama | F02D 13/0284 123/65 PE |
| 7,069,918 | B2 * | 7/2006 | Mackey | F02B 75/22 123/568.12 |
| 2011/0315129 | A1 * | 12/2011 | Kojima et al. | F02M 26/19 123/568.12 |
| 2013/0086891 | A1 * | 4/2013 | Ko | F02F 1/243 60/278 |

(Continued)

FOREIGN PATENT DOCUMENTS

| | | | | |
|---|---|---|---|---|
| EP | 2077385 | A1 * | 7/2009 | F02F 1/38 |
| JP | 6008532 | B2 * | 10/2016 | |

*Primary Examiner* — Jason D Shanske

(74) *Attorney, Agent, or Firm* — Vivacqua Crane

(57) ABSTRACT

An automobile vehicle engine exhaust system with integrated exhaust gas recirculation portion includes a cylinder head having a first exhaust passage internal to the cylinder head. The first exhaust passage is split within the cylinder head into a dedicated exhaust passage opening out of the cylinder head via a dedicated exhaust port, and an exhaust gas recirculation (EGR) exhaust passage opening out of the cylinder head via an EGR exhaust port. A valve assembly is operated to open one of the dedicated exhaust port or the EGR exhaust port while closing the other one of the dedicated exhaust port or the EGR exhaust port.

14 Claims, 4 Drawing Sheets

(56) References Cited

U.S. PATENT DOCUMENTS

| | | | | |
|---|---|---|---|---|
| 2014/0144415 | A1* | 5/2014 | Shimazu | F02F 1/42 123/568.18 |
| 2016/0017847 | A1* | 1/2016 | Hilditch | F02D 41/0002 123/406.48 |
| 2016/0186704 | A1* | 6/2016 | Murotani | F02M 26/28 123/568.12 |
| 2016/0265487 | A1* | 9/2016 | Beyer | F02M 35/104 |
| 2017/0260912 | A1* | 9/2017 | Tsujita | F02D 9/04 |
| 2017/0276095 | A1* | 9/2017 | Beyer | F02M 26/30 |
| 2019/0226422 | A1* | 7/2019 | Horii | F02F 1/4264 |
| 2019/0226427 | A1* | 7/2019 | Uehane | F02F 1/243 |
| 2019/0226428 | A1* | 7/2019 | Uehane | F02B 75/20 |
| 2020/0400108 | A1* | 12/2020 | Kaczmar | F02D 9/1045 |

* cited by examiner

CYLINDER HEAD WITH INTEGRATED EXHAUST MANIFOLD AND DEDICATED EXHAUST GAS RECIRCULATION PORT

INTRODUCTION

The present disclosure relates to an automobile vehicle engine having an exhaust gas recirculation system incorporated into a cylinder head.

Exhaust passages and runners in a conventional engine cylinder head have one flow path. Traditional cylinder heads do not utilize any method or feature for diverting a portion of the exhaust flow path of a multi-cylinder engine. Known exhaust gas recirculation (EGR) systems draw a portion of the exhaust gases from all exhaust runners in a cylinder head and return the exhaust gas to a cylinder inlet path. The returned exhaust gas provides preheat energy for the incoming fuel and air mixture entering the cylinder intake manifold and helps to reduce overall fuel consumption during EGR system operation. Known EGR systems provide an EGR exhaust gas flow path external to the cylinder head. Externally mounting the EGR system components normally requires EGR component mounting features such as flanges, seals, and fasteners. Known EGR systems also require external cooling supplied such as by coolant supply and return piping directed to the EGR components.

Thus, while current exhaust gas recirculation (EGR) systems achieve their intended purpose, there is a need for a new and improved system and method for reconfiguring EGR system components to save weight, cost and to reduce complexity.

SUMMARY

According to several aspects, an automobile vehicle engine exhaust system with integrated exhaust gas recirculation portion includes a cylinder head having a first exhaust passage internal to the cylinder head. The first exhaust passage is split within the cylinder head into: a dedicated exhaust passage opening out of the cylinder head via a dedicated exhaust port; and an exhaust gas recirculation (EGR) exhaust passage opening out of the cylinder head via an EGR exhaust port. A valve assembly is operated to open one of the dedicated exhaust port or the EGR exhaust port while closing the other one of the dedicated exhaust port or the EGR exhaust port.

In another aspect of the present disclosure, the valve assembly includes: a shaft; and a first butterfly valve fixed for rotation on the shaft and aligned with the dedicated exhaust passage. The first butterfly valve is moved by axial rotation of the shaft between a first butterfly valve open position allowing exhaust gas passage through the dedicated exhaust port and a first butterfly valve closed position preventing exhaust gas passage through the dedicated exhaust port.

In another aspect of the present disclosure, the valve assembly includes a second butterfly valve fixed for rotation on the shaft and aligned with the EGR exhaust port. The second butterfly valve is oriented approximately 90-degrees on the shaft from a position of the first butterfly valve and is moved by axial rotation of the shaft between a second butterfly valve open position allowing exhaust gas passage through the EGR exhaust port and a second butterfly valve closed position preventing exhaust gas passage through the EGR exhaust port.

In another aspect of the present disclosure, the valve assembly is positioned within an exhaust manifold connected to the cylinder head.

In another aspect of the present disclosure, a control valve housing is positioned in the first exhaust passage to receive exhaust gas from the first exhaust passage. The control valve housing is directly connected to the dedicated exhaust passage and to the EGR exhaust passage.

In another aspect of the present disclosure, the control valve housing includes a cylindrical-shaped chamber. The valve assembly is rotatably disposed within the cylindrical-shaped chamber.

In another aspect of the present disclosure, the valve assembly further includes multiple arms. A seal is retained at a free end of the arms, the seal making sealing contact with an inner wall of the cylindrical-shaped chamber during rotation of the valve assembly.

In another aspect of the present disclosure, an arm extension is provided with one of the arms, the arm extension sized to prevent exhaust gas flow into either the dedicated exhaust passage or into the EGR exhaust passage depending on a rotated position of the valve assembly.

In another aspect of the present disclosure, the valve assembly includes a longitudinal bore having a motor shaft extending therethrough, the valve assembly connected to the motor shaft.

In another aspect of the present disclosure, the motor shaft and thereby the valve assembly are co-rotated with respect to a longitudinal central axis of the valve assembly by energizing an operator contained within or attached to the control valve housing.

According to several aspects, an automobile vehicle engine exhaust system with integrated exhaust gas recirculation portion includes a cylinder head of an engine having a first exhaust passage internal to the cylinder head. The first exhaust passage is split within the cylinder head into: a dedicated exhaust passage opening out of the cylinder head via a dedicated exhaust port; and an exhaust gas recirculation (EGR) exhaust passage opening out of the cylinder head via an EGR exhaust port. A valve assembly is operated to open one of the dedicated exhaust port or the EGR exhaust port allowing exhaust gas flow while closing the other one of the dedicated exhaust port or the EGR exhaust port preventing the exhaust gas flow. The cylinder head further including at least a second exhaust passage internal to the cylinder head. The second exhaust passage is a passive exhaust passage not provided with individual flow control capability and therefore providing uninterrupted exhaust gas flow during operation of the engine.

In another aspect of the present disclosure, the valve assembly includes: a shaft; a first butterfly valve fixed for rotation on the shaft and aligned with the dedicated exhaust passage; and a second butterfly valve fixed for rotation on the shaft aligned with the EGR exhaust port.

In another aspect of the present disclosure, an exhaust manifold is connected to the cylinder head. The valve assembly is positioned within the exhaust manifold. An operator is connected to and rotates the shaft. The first butterfly valve and the second butterfly valve are operated by rotating the shaft about a longitudinal axis of rotation of the shaft.

In another aspect of the present disclosure, the operator is positioned external to the exhaust manifold and external to the cylinder head.

In another aspect of the present disclosure, the second butterfly valve is oriented on the shaft approximately 90-degrees with respect to the first butterfly valve.

In another aspect of the present disclosure, the cylinder head further includes at least a second exhaust passage, a third exhaust passage and a fourth exhaust passage positioned internal to the cylinder head. The second, third and fourth exhaust passages define passive exhaust passages not provided with individual flow control capability and therefore providing uninterrupted exhaust gas flow during operation of the engine.

In another aspect of the present disclosure, the second exhaust passage and the third exhaust passage are combined within the cylinder head into a combined exhaust passage.

According to several aspects, an automobile vehicle engine exhaust system with integrated exhaust gas recirculation portion includes a cylinder head of an engine having a first exhaust passage internal to the cylinder head. The first exhaust passage is split within the cylinder head into: a dedicated exhaust passage opening out of the cylinder head via a dedicated exhaust port; and an exhaust gas recirculation (EGR) exhaust passage opening out of the cylinder head via an EGR exhaust port. A valve assembly is operated to open one of the dedicated exhaust port or the EGR exhaust port allowing exhaust gas flow while closing the other one of the dedicated exhaust port or the EGR exhaust port preventing the exhaust gas flow. An exhaust manifold is connected to the cylinder head. The valve assembly is positioned within the exhaust manifold.

In another aspect of the present disclosure, the cylinder head further includes at least a second exhaust passage internal to the cylinder head. The second exhaust passage is a passive exhaust passage not provided with individual flow control capability and therefore providing uninterrupted exhaust gas flow during operation of the engine.

In another aspect of the present disclosure, the cylinder head further includes at least a second exhaust passage, a third exhaust passage and a fourth exhaust passage positioned internal to the cylinder head. The second, third and fourth exhaust passages define passive exhaust passages not provided with individual flow control capability and therefore providing uninterrupted exhaust gas flow during operation of the engine.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
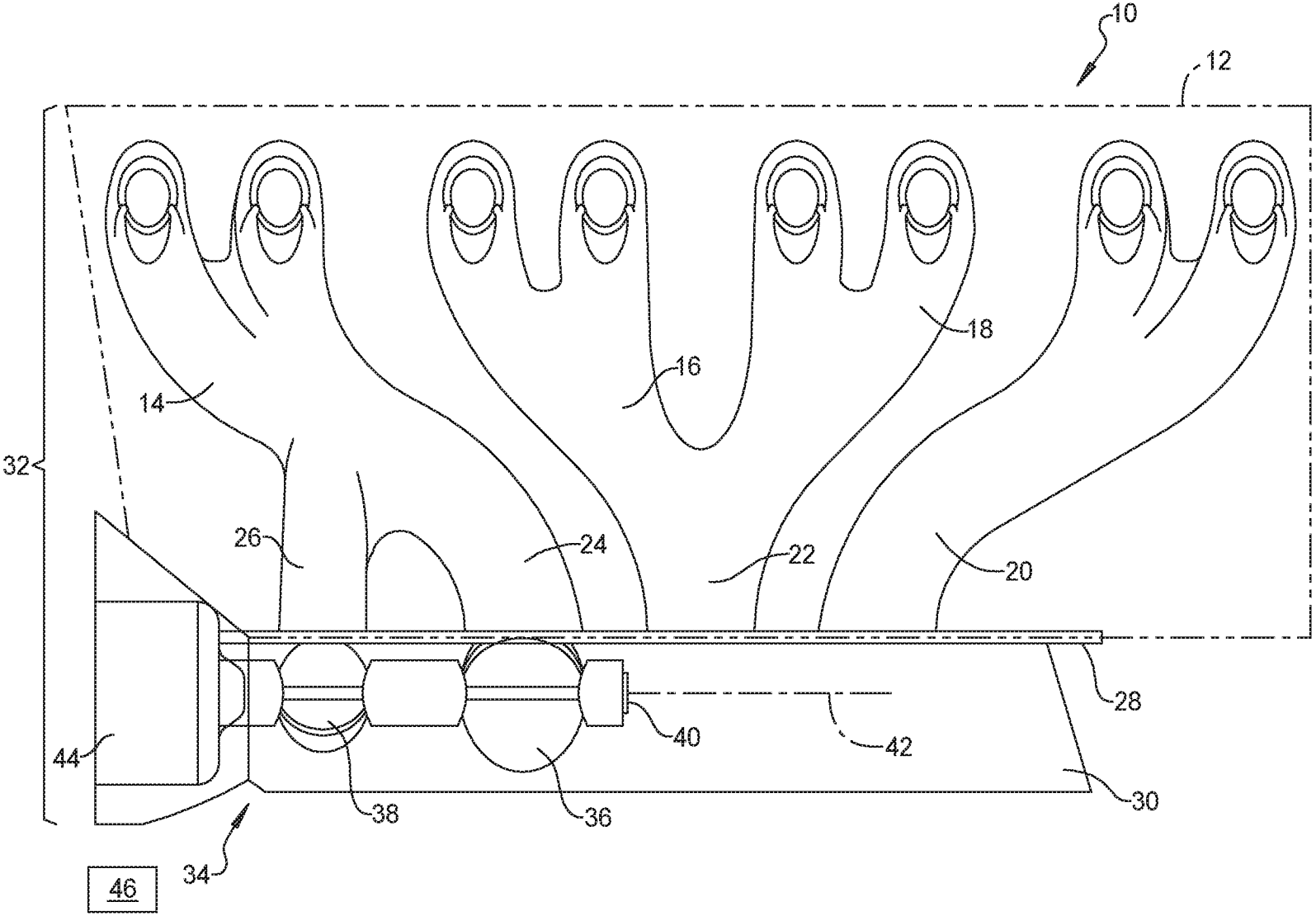
FIG. 1 is a top plan view of an internal passage configuration for an engine manifold adapted to provide a dedicated internal EGR port according to an exemplary aspect.

Referring to FIG. 1, an engine exhaust system with integrated EGR portion 10 is provided for a cylinder head 12. Multiple internal exhaust flow passages of the cylinder head 12 are shown with other features of the cylinder head 12 removed for clarity in FIG. 1. External features of the cylinder head 12 are shown in greater detail in reference to FIG. 2. The cylinder head 12 can be cast from a metal such as aluminum or steel.

The multiple internal exhaust flow passages of the cylinder head 12 include multiple exhaust passages individually communicating with a combustion chamber of a multi-cylinder engine (not shown for clarity). According to an exemplary aspect shown the multiple exhaust passages include a first exhaust passage 14, a second exhaust passage 16, a third exhaust passage 18 and a fourth exhaust passage 20. According to several aspects, the second exhaust passage 16 and the third exhaust passage 18 are internally joined into a combined exhaust passage 22. The first exhaust passage 14, the second exhaust passage 16, the third exhaust passage 18 and the fourth exhaust passage 20 receive exhaust flow from the engine cylinders (not shown for clarity).

Exhaust gas recirculation (EGR) is provided by splitting the first exhaust passage 14 within the cylinder head 12 into a dedicated exhaust passage 24 and an EGR exhaust passage 26. The first exhaust passage 14 is an active exhaust passage which is provided with individual flow control capability described below and therefore provides for interrupted exhaust gas flow during engine operation. The second exhaust passage 16, the third exhaust passage 18 and the fourth exhaust passage 20 are passive exhaust passages which are not provided with individual flow control capability and therefore provide uninterrupted exhaust gas flow during engine operation.

The cylinder head 12 is mounted, for example by fastening, to a flange 28 of an exhaust manifold 30. According to several aspects, a valve assembly 34 is positioned within the exhaust manifold 30. The valve assembly 34 includes a first butterfly valve 36 aligned with the dedicated exhaust passage 24 and therefore operating to either allow flow through the dedicated exhaust passage 24 or when repositioned to prevent or block exhaust flow out of the dedicated exhaust passage 24. The valve assembly 34 also includes a second butterfly valve 38 aligned with the EGR exhaust passage 26 and therefore operating to either allow flow through the EGR exhaust passage 26 to be used for EGR flow or when repositioned will prevent or block exhaust flow out of the EGR exhaust passage 26.

The first butterfly valve 36 and the second butterfly valve 38 are commonly mounted and co-rotated with respect to a valve shaft 40. The first butterfly valve 36 is positioned on the valve shaft 40 approximately 90 axial degrees rotated from the second butterfly valve 38. The 90 positions of the first butterfly valve 36 and the second butterfly valve 38 ensure one of the valves is closed when the other one of the valves is open. The first butterfly valve 36 and the second butterfly valve 38 are operated by rotating the valve shaft 40 about a longitudinal axis of rotation 42 by operation of an operator 44 such as an electric motor. According to several aspects the operator 44 is positioned external to the exhaust manifold 30 and external to the cylinder head 12. Actuation of the operator 44 is controlled using a command device 46 such as an engine controller of known design. The command device 46 can be a computer, a control circuit or a similar electronic device which monitors operating conditions of an engine received from various sensors, throttle position, transmission drive position, and the like, compares the operating conditions to criteria and thresholds saved in a memory, and determines when EGR operation is authorized, and therefore when to close the first butterfly valve 36 and to open the second butterfly valve 38.

Referring to FIG. 2 and again to FIG. 1, an exemplary configuration of the cylinder head 12 is provided. The cylinder head 12 has a cast body 48 of a metal such as aluminum or steel. The dedicated exhaust passage 24 opens out of the cylinder head 12 via a dedicated exhaust port 50, the EGR exhaust passage 26 opens out of the cylinder head 12 via an EGR exhaust port 52, the combined exhaust passage 22 opens out of the cylinder head 12 via a combined exhaust port 54, and the fourth exhaust passage 20 opens out of the cylinder head 12 via a final exhaust port 56. The exhaust ports commonly open at a planar face 58 onto which the exhaust manifold 30 (shown and described in reference to FIG. 2) is mounted, for example using fasteners. It should be apparent that other configurations of an cylinder head modified from cylinder head 12 can also be used within the scope of the present disclosure, including 4-cylinder, 6-cylinder and 8-cylinder or more cylinder heads, with the cylinder head 12 adapted to suit the number of cylinders and for different exhaust passage quantities and geometries.

Figure 2:
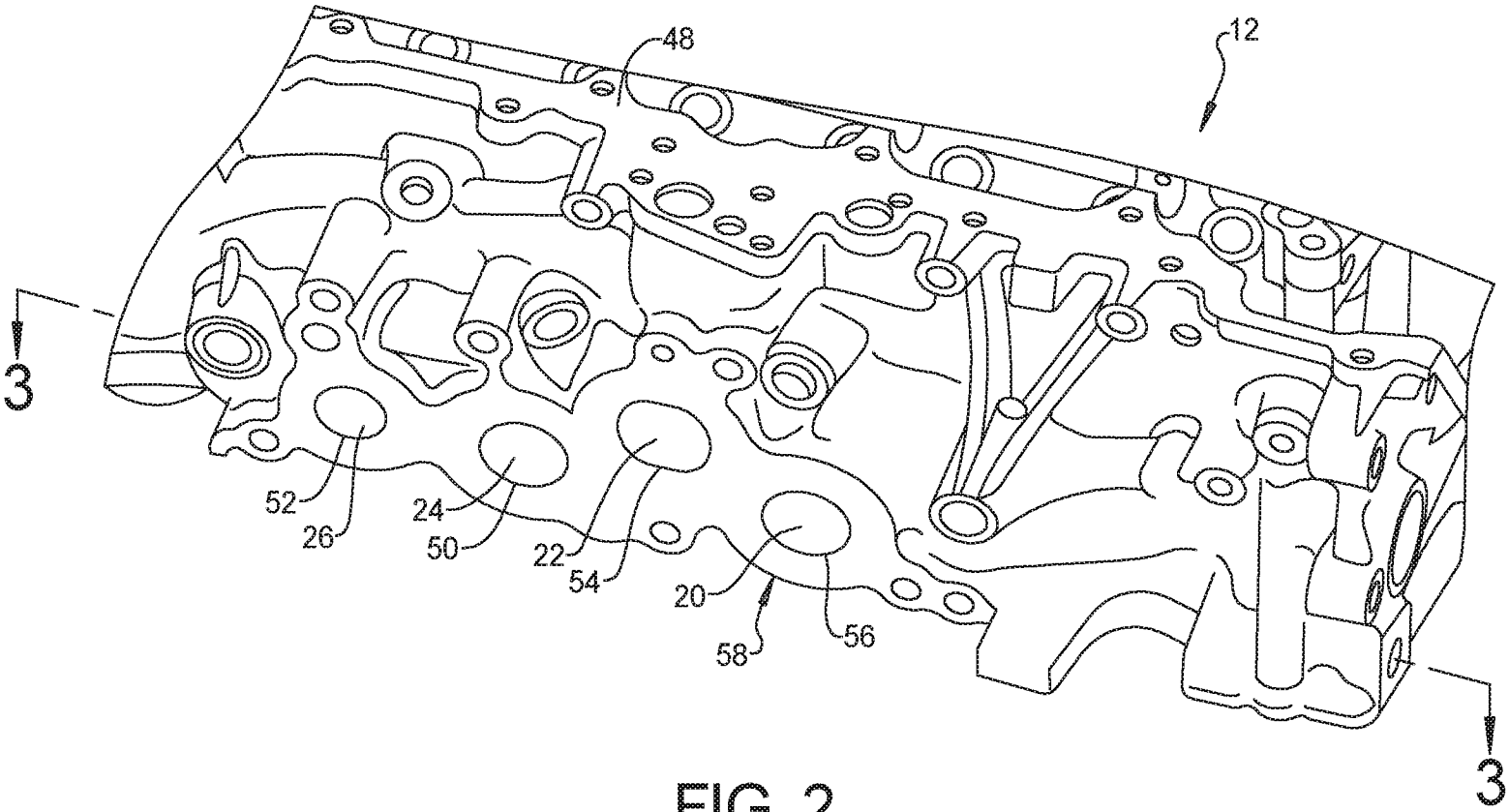
FIG. 2 is a top right perspective view showing the external configuration of a portion of the engine manifold of FIG. 1 adapted to provide the dedicated internal EGR port.
Figure 3:
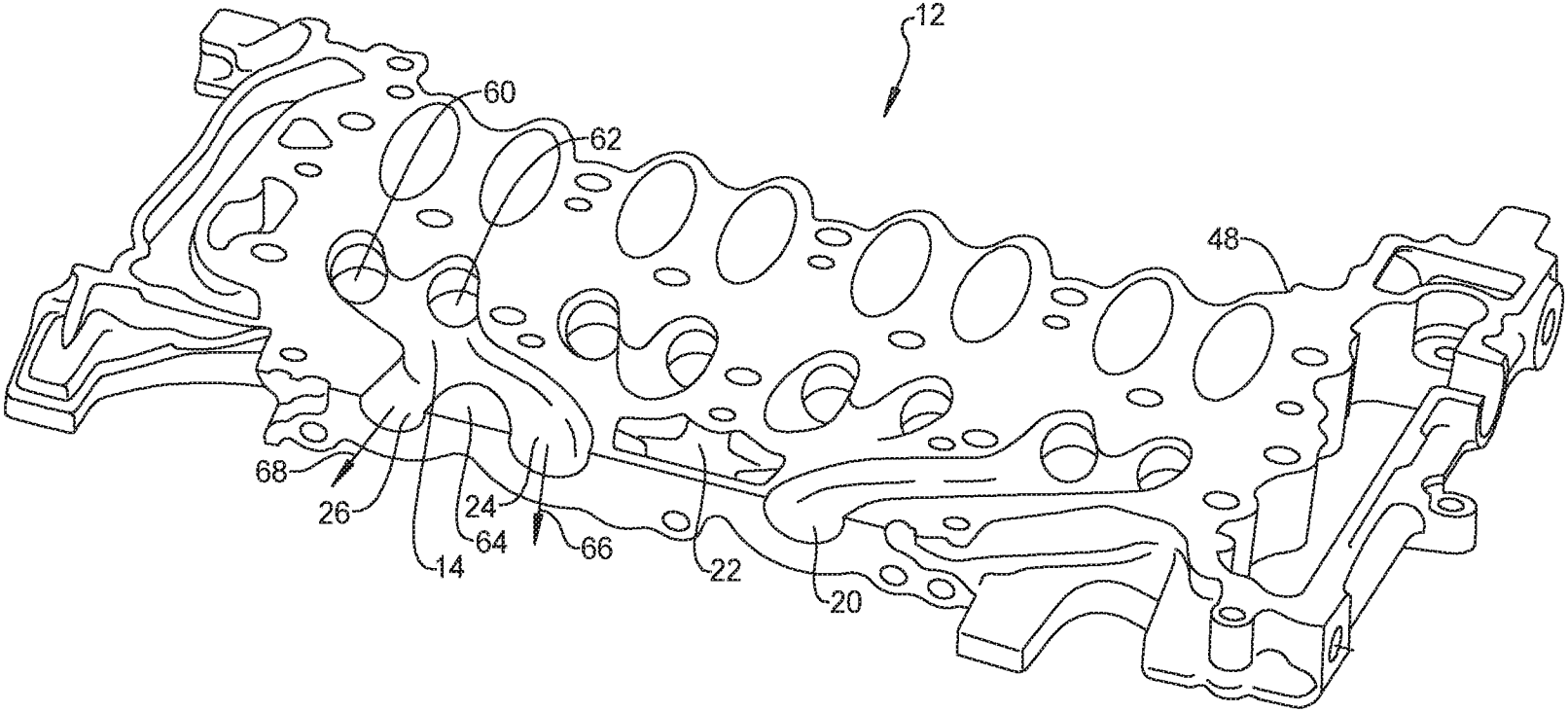
FIG. 3 is a cross sectional top right perspective view taken at section 3 of FIG. 2.

Referring to FIG. 3 and again to FIGS. 1 through 2, the dedicated exhaust passage 24 and the EGR exhaust passage 26 are collectively fed exhaust gas through the first exhaust passage 14. The first exhaust passage 14 communicates with a first exhaust entrance 60 and a second exhaust entrance 62. A dividing wall 64 is homogeneously connected to the cast body 48 which separates flow from the first exhaust passage 14 into the dedicated exhaust passage 24 and the EGR exhaust passage 26. Portions of the combined exhaust passage 22 and the fourth exhaust passage 20 which are not used for EGR operation are also shown.

When EGR operation is not authorized, the first butterfly valve 36 is rotated to or confirmed in an open position which simultaneously rotates the second butterfly valve 38 to a closed position or confirms the second butterfly valve 38 is in the closed position. When EGR operation is not authorized exhaust gas flow is directed from the first exhaust passage 14 into the dedicated exhaust passage 24 in a flow direction 66 and outwardly from the dedicated exhaust passage 24 through the open first butterfly valve 36 (shown in FIG. 1), with the second butterfly valve 38 closed.

When EGR operation is authorized, the second butterfly valve 38 is rotated to an open position which simultaneously rotates the first butterfly valve to a closed position, or the valves are confirmed in these positions. EGR operation directs exhaust gas flow via the first exhaust passage 14 into the EGR exhaust passage 26 in a flow direction 68 and outwardly from the EGR exhaust passage 26 through the open second butterfly valve 38, with the first butterfly valve 36 closed. As previously noted, exhaust flow through the combined exhaust passage 22 and the fourth exhaust passage 20 is passive, and therefore not controlled or limited by the position of either the first butterfly valve 36 or the second butterfly valve 38.

Figure 4:
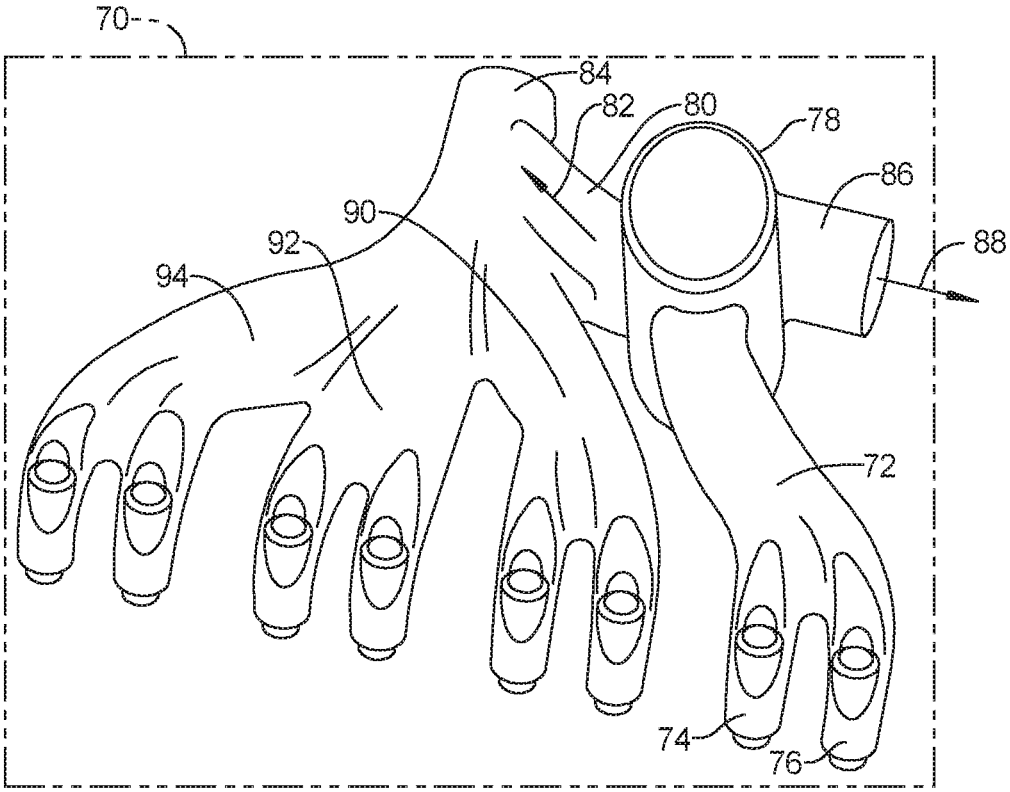
FIG. 4 is a bottom plan view of an internal passage configuration for an engine manifold adapted modified from FIG. 1 to provide a dedicated internal EGR port and an internal valve housing according to an exemplary aspect.

Referring to FIG. 4 and again to FIG. 1, according to several aspects, the engine exhaust system with integrated EGR portion 10 can be modified to provide a cylinder head 70 modified from the cylinder head 12, but with many of the EGR flow paths retained, as follows. The cylinder head 70 includes a first exhaust passage 72 that receives exhaust gas flow from a first exhaust entrance 74 and a second exhaust entrance 76. The first exhaust passage 72 is modified from the first exhaust passage 14 to include a control valve housing 78 which is cast or formed at the same time as the other features of the cylinder head 70. The control valve housing 78 is positioned in the first exhaust passage 72 to receive exhaust gas from the first exhaust entrance 74 and the second exhaust entrance 76 and is directly connected to a dedicated exhaust passage 80. A flow path through the control valve housing 78 is selectively opened into the dedicated exhaust passage 80 similar to the dedicated exhaust passage 24 which directs exhaust gas flow in a flow direction 82 toward a combined exhaust passage discharge port 84.

Figure 5:
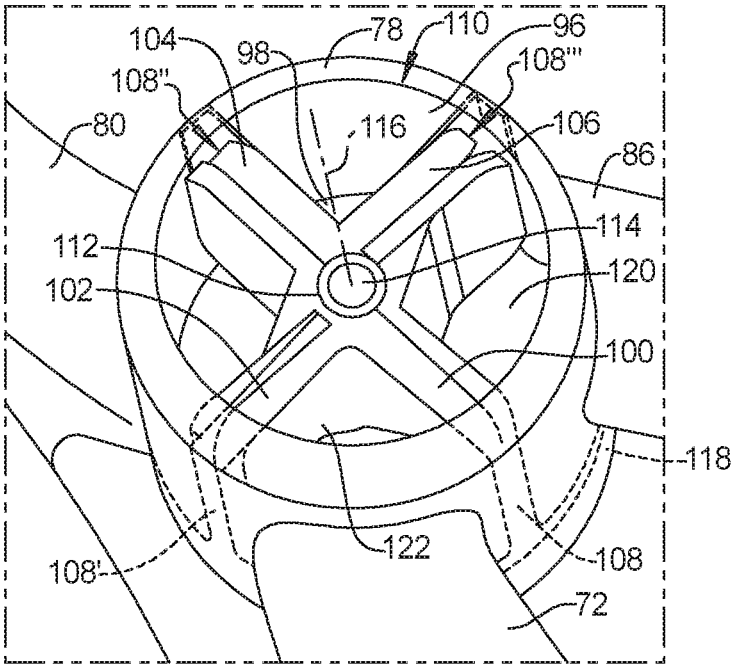
FIG. 5 is a is a partial cross-sectional bottom plan view of area 5 of FIG. 4.

The control valve housing 78 is also directly connected to an EGR exhaust passage 86. For EGR flow a flow path through the control valve housing 78 is selectively opened into the EGR exhaust passage 86 while flow into the dedicated exhaust passage 80 is prevented which discharges EGR exhaust gas flow in a flow direction 88 through the EGR exhaust passage 86. The cylinder head 70 also includes a second exhaust passage 90, a third exhaust passage 92 and a fourth exhaust passage 94 dedicated to second, third and fourth cylinders (not shown). The second exhaust passage 90, the third exhaust passage 92 and the fourth exhaust passage 94 are passive, and therefore are not controlled or limited by operation of a valve positioned in the cylinder head 70 which is described in reference to FIG. 5 and which operates to provide or prevent EGR system flow.

Referring to FIG. 5 and again to FIGS. 1 through 4, the cylinder head 70 includes a cylindrical-shaped chamber 96. A control valve assembly 98 is rotatably disposed within the chamber 96 at a point where the exhaust flow path from the first exhaust passage 72 is managed. According to several aspects a range of rotated positions including 140-degrees up to approximately 220-degrees rotated positions of the control valve assembly 98 determines an exhaust flow path for exhaust gas traveling through the first exhaust passage 72, and directs the exhaust gas either into the dedicated exhaust passage 80 or into the EGR exhaust passage 86.

According to several aspects, the control valve assembly 98 includes four arms, although this quantity is not limiting as more or less than four arms can be used. In the present example, the four arms include a first arm 100, a second arm 102 oriented approximately 90-degrees from the first arm 100, a third arm 104 oriented approximately 90-degrees from the second arm 102, and a fourth arm 106 oriented approximately 90-degrees from the third arm 104, although the arm spacing can also be irregular. The first arm 100, the second arm 102, the third arm 104 and the fourth arm 106 have a seal 108, 108', 108", 108'" retained at a free end of the arms, with the seals 108, 108', 108", 108'" making sealing contact with an inner wall 110 of the chamber 96 during rotation of the control valve assembly 98.

The control valve assembly 98 may include a longitudinal bore 112 through which a motor shaft 114 extends. The control valve assembly 98 is fixedly or releasably connected to the motor shaft 114. The motor shaft 114 and thereby the control valve assembly 98 are co-rotated with respect to a longitudinal central axis 116 of the control valve assembly 98 by energizing an operator 118 such as an electric motor contained within or attached to the control valve housing 78 which can directly or indirectly rotate the motor shaft 114. According to several aspects, an arm extension 120 is provided with one of the arms, for example at a free end of the first arm 100 as shown. The arm extension 120 is sized to prevent exhaust gas flow into either the dedicated exhaust passage 80 or into the EGR exhaust passage 86 depending on the rotated position of the control valve assembly 98. The control valve assembly 98 is therefore rotated in a range of approximately 140-degree to 220-degree increments by operation of the operator 118 depending on the orientation of the dedicated exhaust passage 80 with respect to an orientation the EGR exhaust passage 86. With the arm extension 120 of the control valve assembly 98 preventing one of the dedicated exhaust passage 80 or the EGR exhaust passage 86, exhaust gas from the first exhaust passage 72 is forced to flow through an open passage 122 to the open one of the dedicated exhaust passage 80 or the EGR exhaust passage 86.

An engine exhaust system with integrated EGR portion of the present disclosure offers several advantages. These include creation of two flow paths internal to a multi-cylinder head that support exhaust flow path determination with OR-logic from one cylinder of a multi-cylinder engine. The multi-cylinder head also integrates an EGR flow path within the cylinder head to feed an EGR valve, which is differentiated from an external flow path pre-valve. According to several aspects, both an EGR flow path and an EGR valve are positioned within the multi-cylinder head which minimizes space external to the multi-cylinder head required to accomplish EGR operation.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. An automobile vehicle engine exhaust system with integrated exhaust gas recirculation portion, comprising:

a cylinder head having a first exhaust passage and a second exhaust passage internal to the cylinder head, the first exhaust passage is split within the cylinder head into:

a dedicated exhaust passage opening out of the cylinder head via a dedicated exhaust port;

an exhaust gas recirculation (EGR) exhaust passage opening out of the cylinder head via an EGR exhaust port;

a valve assembly operated to open one of the dedicated exhaust port or the EGR exhaust port while closing the other one of the dedicated exhaust port or the EGR exhaust port, wherein the valve assembly is positioned within an exhaust manifold connected to the cylinder head; and a controller operatively connected to the valve assembly, wherein the controller is configured to authorize an EGR operation based on a comparison of an operating condition to a threshold and to cause the valve assembly to open the EGR exhaust port when the EGR operation is authorized, wherein the controller is configured to actuate an operator, the operator operatively connected to the valve assembly and positioned external to the cylinder head and external to the exhaust manifold.

2. The automobile vehicle engine exhaust system with integrated exhaust gas recirculation portion of claim 1, wherein the valve assembly includes:

a shaft; and a first butterfly valve fixed for rotation on the shaft and aligned with the dedicated exhaust passage, the first butterfly valve moved by axial rotation of the shaft between a first butterfly valve open position allowing exhaust gas passage through the dedicated exhaust port and a first butterfly valve closed position preventing exhaust gas passage through the dedicated exhaust port.

3. The automobile vehicle engine exhaust system with integrated exhaust gas recirculation portion of claim 2, wherein the valve assembly includes:

a second butterfly valve fixed for rotation on the shaft and aligned with the EGR exhaust port; and the second butterfly valve is oriented approximately 90-degrees on the shaft from a position of the first butterfly valve and moved by axial rotation of the shaft between a second butterfly valve open position allowing exhaust gas passage through the EGR exhaust port and a second butterfly valve closed position preventing exhaust gas passage through the EGR exhaust port.

4. The automobile vehicle engine exhaust system with integrated exhaust gas recirculation portion of claim 1, wherein the cylinder head comprises a cast body, the cast body including a dividing wall that separates the dedicated exhaust passage opening and the EGR exhaust passage.

5. An automobile vehicle engine exhaust system with integrated exhaust gas recirculation portion, comprising:

a cylinder head of an engine having a first exhaust passage internal to the cylinder head, the first exhaust passage split within the cylinder head into:

a dedicated exhaust passage opening out of the cylinder head via a dedicated exhaust port; and an exhaust gas recirculation (EGR) exhaust passage opening out of the cylinder head via an EGR exhaust port;

a valve assembly operated to open one of the dedicated exhaust port or the EGR exhaust port allowing exhaust gas flow while closing the other one of the dedicated exhaust port or the EGR exhaust port preventing the exhaust gas flow;

the cylinder head further including at least a second exhaust passage internal to the cylinder head, the second exhaust passage being a passive exhaust passage not provided with individual flow control capability and therefore providing uninterrupted exhaust gas flow during operation of the engine, wherein the valve assembly is positioned within an exhaust manifold connected to the cylinder head; and a controller operatively connected to the valve assembly, wherein the controller is configured to authorize an EGR operation based on a comparison of an operating condition to a threshold and to cause the valve assembly to open the EGR exhaust port when the EGR operation is authorized.

6. The automobile vehicle engine exhaust system with integrated exhaust gas recirculation portion of claim 5, wherein the valve assembly includes:

a shaft;

a first butterfly valve fixed for rotation on the shaft and aligned with the dedicated exhaust passage; and a second butterfly valve fixed for rotation on the shaft aligned with the EGR exhaust port.

7. The automobile vehicle engine exhaust system with integrated exhaust gas recirculation portion of claim 6, further including:

an operator connected to and rotating the shaft, the first butterfly valve and the second butterfly valve operated by rotating the shaft on a longitudinal axis of rotation of the shaft.

8. The automobile vehicle engine exhaust system with integrated exhaust gas recirculation portion of claim 7, wherein the operator is positioned external to the exhaust manifold and external to the cylinder head, wherein the controller is operatively connected to the operator and configured to actuate the operator.

9. The automobile vehicle engine exhaust system with integrated exhaust gas recirculation portion of claim 6, wherein the second butterfly valve is oriented on a shaft approximately 90-degrees with respect to the first butterfly valve.

10. The automobile vehicle engine exhaust system with integrated exhaust gas recirculation portion of claim 5, wherein the cylinder head further includes a third exhaust passage and a fourth exhaust passage positioned internal to the cylinder head, the second, third and fourth exhaust passages defining passive exhaust passages not provided with individual flow control capability and therefore providing uninterrupted exhaust gas flow during operation of the engine.

11. The automobile vehicle engine exhaust system with integrated exhaust gas recirculation portion of claim 10, wherein the second exhaust passage and the third exhaust passage are combined within the cylinder head into a combined exhaust passage.

12. An automobile vehicle engine exhaust system with integrated exhaust gas recirculation portion, comprising:

a cylinder head of an engine having a first exhaust passage internal to the cylinder head, the first exhaust passage split within the cylinder head into:

a dedicated exhaust passage opening out of the cylinder head via a dedicated exhaust port; and an exhaust gas recirculation (EGR) exhaust passage opening out of the cylinder head via an EGR exhaust port;

a valve assembly operated to open one of the dedicated exhaust port or the EGR exhaust port allowing exhaust gas flow while closing the other one of the dedicated exhaust port or the EGR exhaust port preventing the exhaust gas flow;

an exhaust manifold connected to the cylinder head, the valve assembly positioned within the exhaust manifold; and a controller operatively connected to the valve assembly, wherein the controller is configured to authorize an EGR operation based on a comparison of an operating condition to a threshold and to cause the valve assembly to open the EGR exhaust port when the EGR operation is authorized, wherein the controller is configured to actuate an operator, the operator operatively connected to the valve assembly and positioned external to the cylinder head and external to the exhaust manifold.

13. The automobile vehicle engine exhaust system with integrated exhaust gas recirculation portion of claim 12, wherein the valve assembly includes:

a shaft;

a first butterfly valve fixed for rotation on the shaft and aligned with the dedicated exhaust passage; and a second butterfly valve fixed for rotation on the shaft and oriented approximately 90-degrees with respect to the first butterfly valve and aligned with the EGR exhaust port.

14. The automobile vehicle engine exhaust system with integrated exhaust gas recirculation portion of claim 12, wherein the cylinder head further includes a second exhaust passage, a third exhaust passage and a fourth exhaust passage positioned internal to the cylinder head, the second, third and fourth exhaust passages defining passive exhaust passages not provided with individual flow control capability and therefore providing uninterrupted exhaust gas flow during operation of the engine.

* * * * *